US005177938A

United States Patent [19]

Mayersbeth

[11] Patent Number: 5,177,938

[45] Date of Patent: Jan. 12, 1993

[54] PACKAGING METHOD AND APPARATUS

[75] Inventor: Robert E. Mayersbeth, Berkhampstead, United Kingdom

[73] Assignee: Ilapak, Inc., Newtown, Pa.

[21] Appl. No.: 743,702

[22] Filed: Aug. 12, 1991

[30] Foreign Application Priority Data

Aug. 14, 1990 [GB] United Kingdom ..... 9017797

[51] Int. Cl.[5] ..... B65B 1/24; B65B 1/32

[52] U.S. Cl. ..... 53/502; 53/436; 53/530; 53/551

[58] Field of Search ..... 53/436, 439, 530, 529, 53/502, 551, 552, 550, 554, 555, 553, 450, 527

[56] References Cited

U.S. PATENT DOCUMENTS

| | | | |
|---|---|---|---|
| 3,621,775 | 11/1971 | Dedio et al. | 53/530 X |
| 4,128,985 | 12/1978 | Simmons | 53/502 X |
| 4,516,387 | 5/1985 | Kupcikevicius | 53/530 |
| 4,548,286 | 10/1985 | Sashiki et al. | 53/502 X |
| 5,041,297 | 8/1991 | Dowaliby | 53/529 X |

FOREIGN PATENT DOCUMENTS

| | | | |
|---|---|---|---|
| 2926161 | 1/1981 | Fed. Rep. of Germany | 53/502 |

*Primary Examiner*—James F. Coan
*Attorney, Agent, or Firm*—Gregory J. Gore

[57] ABSTRACT

Improved reliability of packaging metered batches of difficult-to-pack products is achieved by a method which includes pushing the trailing end of each metered batch of product out of the bottom of a hopper by an extendible member operating in synchronism with a form-fill-and-seal packaging machine. The extendible member comprises a double-acting rodless cylinder moving a support for a double-acting rod cylinder along the slideway, the cylinder rod carrying the head of a compacting member. The extendible member is thus made small enough to be located in the upper part of the hopper, yet has sufficient stroke length to cause the compacting head to reach down through the lower end of the hopper.

7 Claims, 3 Drawing Sheets

PACKAGING METHOD AND APPARATUS

FIELD OF THE INVENTION

This invention relates in general to the packaging of difficult-to-pack products that require a measure of compaction to locate them satisfactorily in the intended packaging container and in particular, but not exclusively, to the packaging of vegetable leaves in vertical form-fill-and-seal packages.

BACKGROUND OF THE INVENTION AND PRIOR ART

Hoppers are commonly used to feed product downwardly into packaging containers. In the case of vertical form-fill-and-seal packaging, the lower end of the hopper can be disposed just above the level at which the successive spaced-apart transverse seals are created in the formed tubular packaging material to separate the accurately metered batches of product fed down one after the other through the hopper. The metering may be by volume, number or weight. In any event, it is important that all the product in each batch entering the top of the hopper constitutes that batch when it enters the partly formed package at the bottom of the hopper, so that at all times, it is correctly metered batches which are being packaged.

Many products are sufficiently fluent in the hopper to reliably pass therethrough under the influence of gravity alone. However, some products are notoriously difficult to package on vertical form-fill-and-seal packaging machines, because the product gets caught in the hopper causing underweight packages to be formed and ultimately cessation of the packaging process while the hopper is cleared of obstructions. Some products not only tend to adhere to the hopper wall(s), but the product making up a batch does not naturally form a compact mass for economical packaging. One product range which has proved difficult to package reliably in vertical form-fill-and-seal machines is fresh vegetable leaves and notably spinach leaves. In a known prior art arrangement, the forming of 500 g packages of fresh spinach leaves cannot be completed at more than 7 to 8 packages a minute, and then only with continuous operator supervision and frequent manual intervention. Further, the 500 g packages produced are some 500 mm long, more than 50% longer than necessary if satisfactory compaction of the leaves could be achieved.

SUMMARY OF THE INVENTION

We have now discovered that greatly improved reliability of packaging metered batches of these difficult-to-pack products can be achieved by a method which involves pushing the trailing end of each metered batch out of the bottom of the hopper with an extendible member operating in synchronism with the packaging machine. Conveniently, the extendible member comprises a double-acting rodless cylinder moving a support for a double-acting rod cylinder along a slideway, the cylinder rod carrying the head of a compacting member. Using two cylinders in this way enables the extendible member to be made small enough to be located in the wide upper part of the hopper, where product can drop down around it, without interfering with the metering means supplying product to the hopper and yet to have a stroke length sufficient to cause the head to reach down to the lower end of the hopper.

Suitably, the slideway on which the support for the double-acting rod cylinder moves has a pair of opposed V-shaped rail portions, each located in a V-groove in the support.

Desirably, the hopper is located below a combination weigher having a plurality of pre-weighted sub-batches available for collectively creating the required weight of product to be batched together to make the packaged product, computer means being used to select which of and how many of the pre-weighed sub-batches will most closely exceed the required weight of the product. Combination weighers of this kind are well-known in the packaging industry and need not be more fully described here.

A preferred packaging method according to this invention uses a rodless cylinder with a maximum stroke which exceeds half the maximum stroke of the rodded cylinder of the extending means. Conveniently, the rodless cylinder stroke is around 500 mm, and the rodded cylinder has a stroke of around 700 mm.

The invention also extends to compacting apparatus comprising an extendible member located in a product-dispensing hopper, the extendible member comprising a double-acting rodless cylinder moving a support for a double-acting rod cylinder along a slideway. Suitably, the slideway comprises opposed V-shaped rail portions, each engaged in a V-groove in the support.

DESCRIPTION OF THE DRAWINGS

One embodiment of apparatus according to the invention will now be described, by way of example, with reference to the accompanying drawings, in which.

DESCRIPTION OF THE PREFERRED EMBODIMENT

Figure 1:
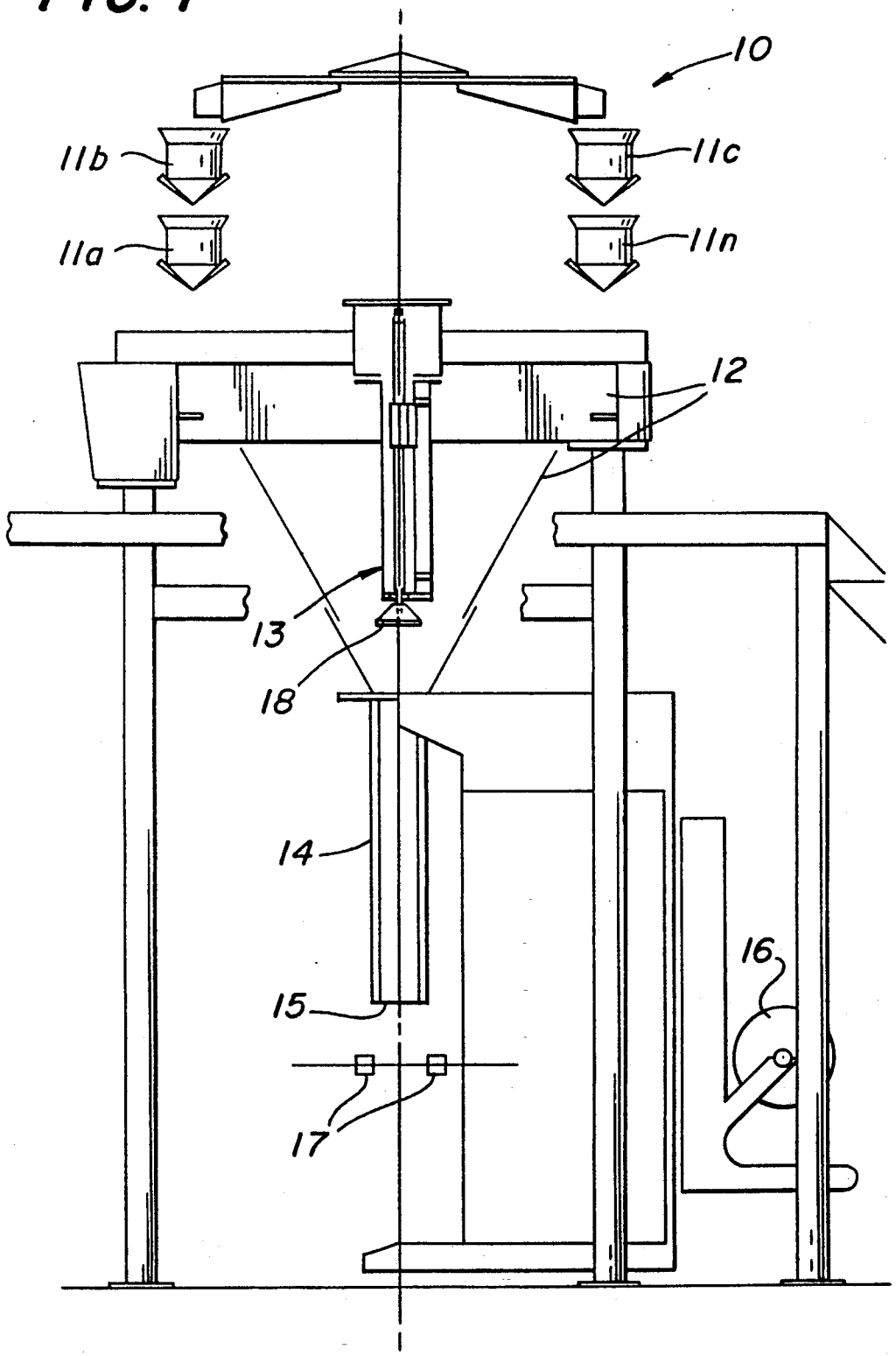
FIG. 1 is a schematic sectional view of the dispensing apparatus used with a vertical form-fill-and-seal packaging machine and a combination weigher.

The dispensing apparatus shown in FIG. 1 comprises a combination weigher 10 accumulating sub-batches of product in a plurality of weigh pans 11*a*, 11*b*, 11*c*. . . 11*n*. The weigh pans are continually filled with sub-batches of product and when a batch is needed for packaging the pans carrying the sub-batches whose total weight is selected to most closely exceed the required weight are emptied by computer control into a hopper 12, the product falling around an extendible member 13 into a dispensing duct 14 forming the outlet of the hopper 12.

The lower end 15 of the duct 14 is located in a vertical tube of packaging film (not shown but formed from material on a roll 16) just above transverse sealing jaws 17 of a vertical form-fill-and-seal machine.

Figure 2:
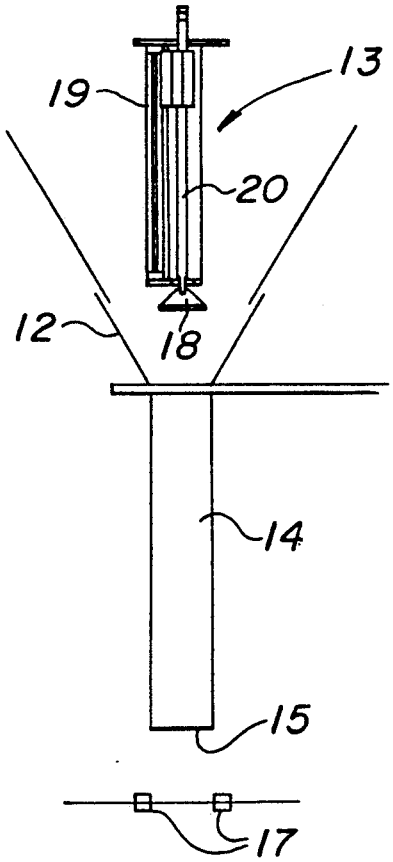
FIGS. 2 and 3 are views of the extendible member in retracted and extended conditions, respectively.
Figure 3:
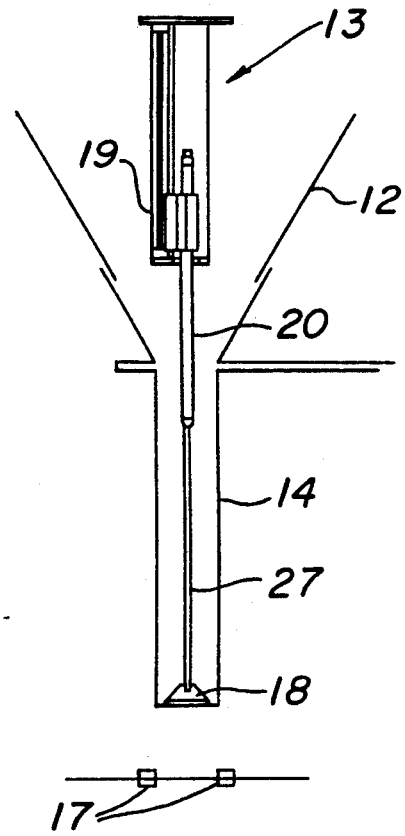

FIG. 2 shows the extendible member 13 in its retracted position which leaves a compacting head 18 clear of the top of the duct 14 so that product dropped from the chosen number of pans 11 can fall around the head 18 and tumble, under the influence of gravity, partially down the duct 14. FIG. 3 shows the member 13 fully extended, the head 18 acting to press the product through the duct 14 and out of the end 15.

To provide a stroke length sufficient to permit the movement between the extremes shown in FIGS. 2 and 3 (which typically can be 1200 mm), a double-acting rodless fluid-actuated cylinder 19 mounting a double-acting fluid-actuated rod cylinder 20 is used.

Figure 4:
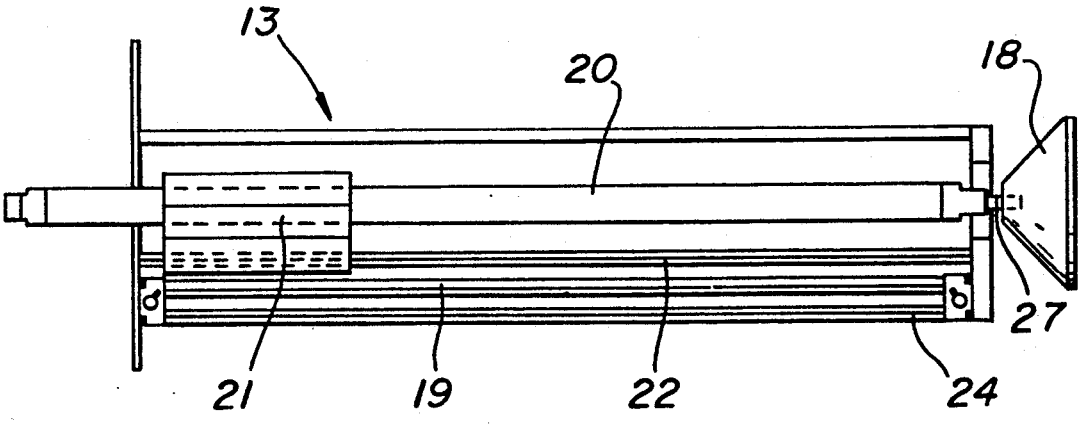
FIG. 4 is a side view of the extendible member in its retracted condition.
Figure 5:
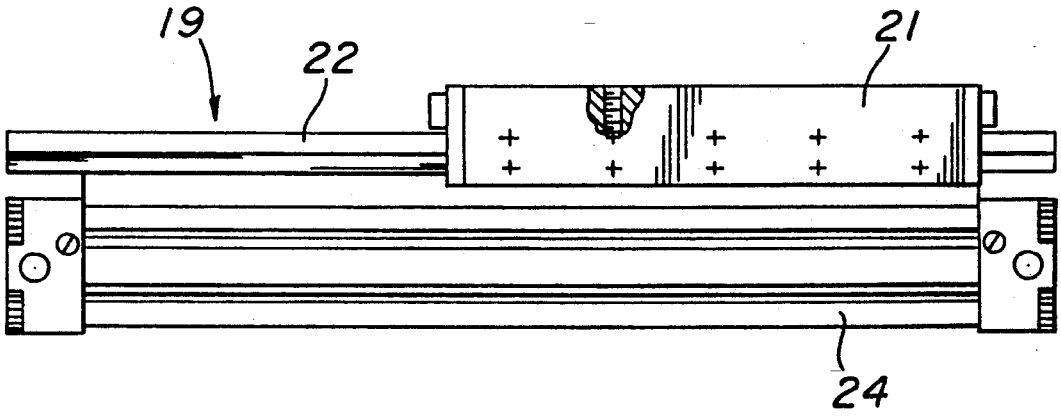
FIGS. 5 to 7 are views of the rodless cylinder used in the member of FIG. 4.
Figure 6:
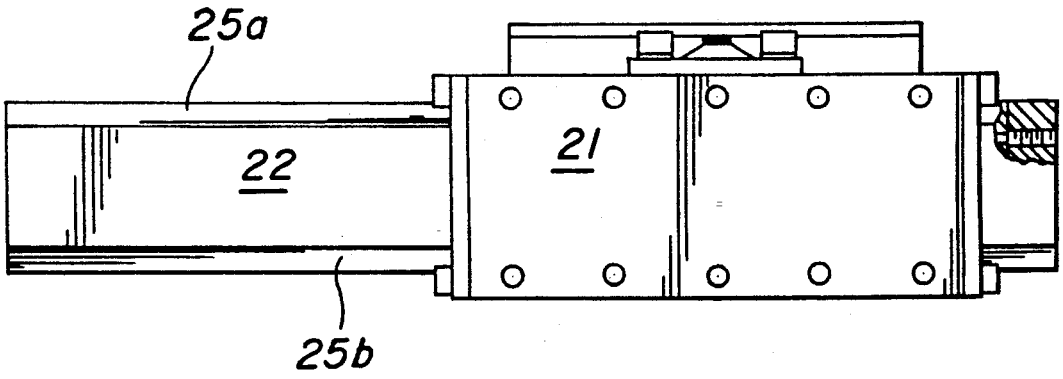
Figure 7:
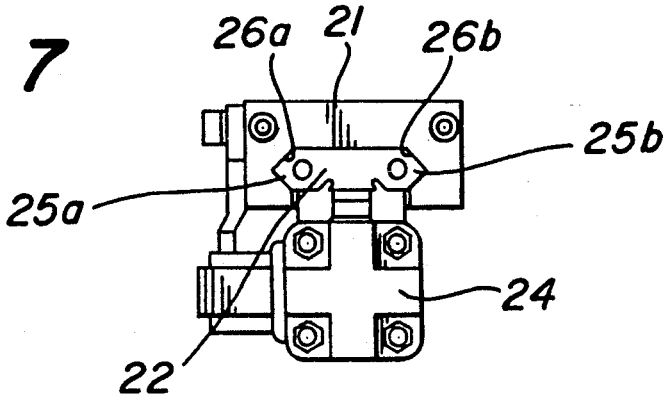

FIG. 4 shows the member 13 in greater detail, and FIGS. 5 to 7 show the cylinder 19 which has a support 21 slideably mounted on a slideway 22, the support being driven from end-to-end of the slideway by means of two flexible bands (not shown), each linked to the support 21 and each connected at its other end to a free piston (not shown) drivably located in a pneumatic cylinder formed in a block 24 below the support 21. From FIGS. 5 to 7 it can be seen that the slideway 22 comprises opposed V-shaped rail portions 25*a*, 25*b*, each engaged in a V-groove 26*a*, 26*b* in the support 21.

The pneumatic rod cylinder 20 is mounted on the support 21 and carries the head 18 at the distal end of the cylinder rod 27 thereof.

In use of the device, synchronized with the operation of the combination weigher 10 and the jaws 17, the head 18 is reciprocated repeatedly to push each set of sub-batches dispensed from the pans 11 into the formed tube of packaging film and compact the product at the same time ready for packaging.

One indication of the advantages achieved by the method of the invention can be judged from the fact that using the apparatus shown in the drawings, but without the extendible member 13. Packages of 500 grams of fresh spinach leaves were produced at the rate of 7 to 8 packages per minute, each package being some 500 mm long. With the extendible member in place and operating, the length of each package could be reduced to 300 mm and, therefore, the packaging rate could be increased to 20 packages per minute. Clearly the reduced size of package and the increased packaging speed possible represent a dramatic economy, particularly when it is realized that full manual supervision is required if the extendible member is not being used and that only minimal supervision is needed when the extendible member is used.

A preferred rodless cylinder is the P230 series produced by Origa Limited of Tewkesbury, England. A preferred combination weigher is a Multiponed MP1434 having 14 heads, each capable of discharging a sub-batch weighing between 1 and 125 grams.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A product compactor in a packaging machine, comprising: a base;

a hopper mounted to said base, said hopper standing vertically and having a product receiving mouth at the top, side walls convergent in the downward direction, and a discharge opening at the bottom;

an extendible member affixed to said base and mounted substantially within said hopper above said discharge opening, said member having a vertical stroke movable between retracted and extended positions;

a compacting head affixed to the bottom end of said extendible member;

a dispensing duct affixed to the bottom of said hopper and positioned such that said compacting head moves into and through said dispensing duct as said extendible member moves between said retracted and extended positions such that product entering the mouth of said hopper which falls by gravity into said dispensing duct is then forced downward through said duct and compressed by the action of said extendible member; and said extendible member comprising two serially actuated cylinders, a double-acting rodless cylinder moving a support for a double-acting rod cylinder along a slideway, the cylinder rod carrying said compacting head.

2. The product compactor of claim 1 wherein said extendible member is centrally located within said hopper.

3. The product compactor of claim 2 wherein said packaging machine is a vertical form-fill-and-seal packaging machine.

4. The product compactor of claim 3 wherein said slideway on which said support for the double-acting rod cylinder moves includes a pair of opposed V-shaped rail portions, each located in a V-groove in said support.

5. The product compactor of claim 4 wherein said hopper is located below a combination weigher having a plurality of pre-weighed product sub-batches collectively creating the total required weight of product to be packaged.

6. The product compactor of claim 5 further described in that said rodless cylinder has a maximum stroke which exceeds half the maximum stroke of the rodded cylinder of said extendible member.

7. The product compactor of claim 6 wherein said rodless cylinder has a stroke of approximately 500 mm, and said rodded cylinder has a stroke of approximately 700 mm.

* * * * *